US005361462A

United States Patent [19]

Murasaki

[11] Patent Number: 5,361,462

[45] Date of Patent: Nov. 8, 1994

[54] MOLDED SURFACE FASTENER

[75] Inventor: Ryuichi Murasaki, Toyama, Japan

[73] Assignee: Yoshida Kogyo K.K., Tokyo, Japan

[21] Appl. No.: 50,656

[22] Filed: Apr. 22, 1993

[30] Foreign Application Priority Data

Apr. 24, 1992 [JP] Japan ..... 4-027364[U]

[51] Int. Cl.[5] ..... A44B 18/00

[52] U.S. Cl. ..... 24/452; 24/442; 24/306

[58] Field of Search ..... 24/442, 452, 297, 306

[56] References Cited

U.S. PATENT DOCUMENTS

| | | | |
|---|---|---|---|
| 2,499,898 | 3/1950 | Anderson . | |
| 3,808,648 | 5/1974 | Billarant et al. | 24/442 X |
| 4,776,068 | 10/1988 | Smirlock et al. | 24/442 |
| 4,929,487 | 5/1990 | Tilman et al. | 24/297 X |
| 4,984,339 | 1/1991 | Provost et al. | 24/442 X |
| 5,088,162 | 2/1992 | Allan . | |
| 5,097,570 | 3/1992 | Gershenson | 24/442 X |
| 5,131,119 | 7/1992 | Murasaki et al. | 24/452 |

FOREIGN PATENT DOCUMENTS

| | | |
|---|---|---|
| 0421295 | 4/1991 | European Pat. Off. . |
| 0464754 | 1/1992 | European Pat. Off. . |
| 52-71808 | 5/1977 | Japan . |
| 2-127205 | 10/1990 | Japan . |

*Primary Examiner*—Edward K. Look
*Assistant Examiner*—Hoang Nguyen
*Attorney, Agent, or Firm*—Hill, Steadman & Simpson

[57] ABSTRACT

A molded surface fastener comprising: first and second engaging parts each including a flat hook bed having on its surface a multiplicity of rows of hooks molded integrally of the hook bed; each hook including a raised portion and a hook-shape engaging portion extending forwardly from a distal end of the raised portion, the raised portion having an inclined back surface smoothly curving upwardly from the hook bed and a vertical front surface, each hook having a varying cross-sectional area increasing gradually from a distal end of the hook-shape engaging portion to the base of the raised portion; and the hooks of the first engaging part and the hooks of the second engaging part being arranged in opposite directions, the row direction pitch of the hooks of one of the first and second engaging parts being twice that of the hooks of the other engaging part.

4 Claims, 3 Drawing Sheets

MOLDED SURFACE FASTENER

BACKGROUND OF THE INVENTION

1. Field of the Invention

The present invention relates to a surface fastener molded from synthetic resin and having first and second engaging parts each in the form of a single molded body, on the hook bed surface of which a large number of engaging elements are formed in rows, which is particularly suitable for adhering industrial materials.

2. Description of the Related Art

The most common surface fastener is the so called velvet type fastener about which a great deal is known. This consists of a combination of a male tape and a female tape. On the whole, the female engaging part consists of knitted or woven loops. When the male engaging part is knitted or woven, it consists of loops, parts of which have been cut to form hooks and when the male engaging part is formed from a single molded body, it consists of various shapes such as, for example, hook, mushroom or anchor shapes. Although, as described above, the knitted or woven loops in themselves have high engaging strength, the overall engaging strength of the female engaging part is weak. Moreover, the positioning ability and the durability of the female engaging part are not of a sufficient standard for applications in the field of industrial materials at present because the loops are too flexible.

The development of molded surface fasteners made from synthetic resin is disclosed in, for example, U.S. Pat. No. 2,499,898, Japanese Utility Model Laid-Open Publication No. Sho 52-71808 and Japanese Utility Model Laid-Open Publication No. Hei 2-127205. These single molded body surface fasteners can have male and female engaging parts both of which can be made from synthetic resin material, which gives a positioning ability and self adhesive strength which is of a remarkably high standard when compared to the knitted or woven female engaging parts described above.

However, either one of the male and female engaging parts in the surface fastener described above will have a basic mushroom shape. The engaging strength resulting from a construction involving this kind of mushroom shape is, of course, weak when compared to those involving hook shapes. Also, if this kind of surface fastener is often used, it will soon lose a great deal of both its engaging strength and its durability.

SUMMARY OF THE INVENTION

It is therefore an object of this invention to provide a surface fastener well suited to industrial materials applications which retains its shape and a high degree of engaging strength even after repeated use.

According to this invention, there is provided a molded surface fastener comprising: first and second engaging parts each including a flat hook bed having on its surface a multiplicity of rows of hooks molded integrally of the flat hook bed; each of the hooks including a raised portion and a hook-shape engaging portion extending forwardly from a distal end of the raised portion, the raised portion having an inclined back surface smoothly curving upwardly from the hook bed and a vertical front surface, each hook having a varying cross-sectional area increasing gradually from a distal end of the hook-shape engaging portion to a base of the raised portion; and the hooks of the first engaging part and the hooks of the second engaging part being arranged mutually in opposite directions, the row direction pitch of the hooks of one of the first and second engaging parts being twice the row direction pitch of the hooks of the other engaging part.

Alternatively, the hooks of adjacent rows of each of the first and second engaging parts may be arranged mutually in opposite directions. Further, the hooks of adjacent rows of each of the first and second engaging parts may be arranged mutually in a staggered manner.

The hooks which make up the engaging parts in this invention are of the shape described above. Also, the interhook spacing along the row direction of one of either the first or second engaging parts is twice that of the interhook spacing along the row direction of the other engaging part. Moreover, the hooks in the hook rows for the first and second engaging parts face in opposite directions. This means that not only can both engaging parts engage with each other smoothly at their moment of engagement, but also, the front ends of the hooks in one of the engaging parts will make contact with the front ends of the hooks in the other engaging parts at the same time as the back sides of the hooks neighboring the aforementioned hooks for one of the engaging parts make contact with the backsides of the corresponding aforementioned hooks for the other engaging part, so that the engaging parts smoothly engage with each other.

The corresponding hooks for each adjacent hook row for the first and second engaging parts face in opposing directions. In addition, each of the hooks for each neighboring hook row for these first and second engaging parts are arranged in a staggered manner, so the hooks are not only held securely in the row direction but are also sufficiently held in the lateral direction.

Moreover, even when separating the first and second engaging parts, if a force in excess of the necessary separation force is applied to both of the engaging parts in the direction of separation, the front ends of the mutually interlocked hook shaped engaging portions will be slightly twisted, and the engaging parts can thus be easily separated.

DETAILED DESCRIPTION

The following is a detailed description of the present invention based on a preferred embodiment shown in the accompanying drawings.

Figure 1:
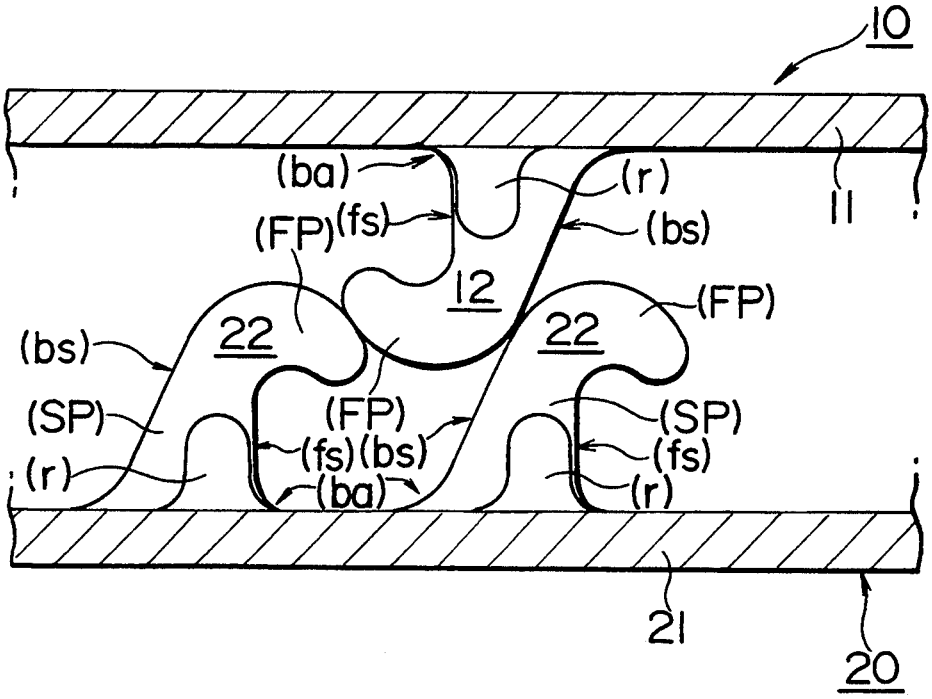
FIG. 1 is a fragmentary side view of a typical embodiment of a molded surface fastener for this invention, showing the surface fastener at the time of initial insertion of hooks.
Figure 2:
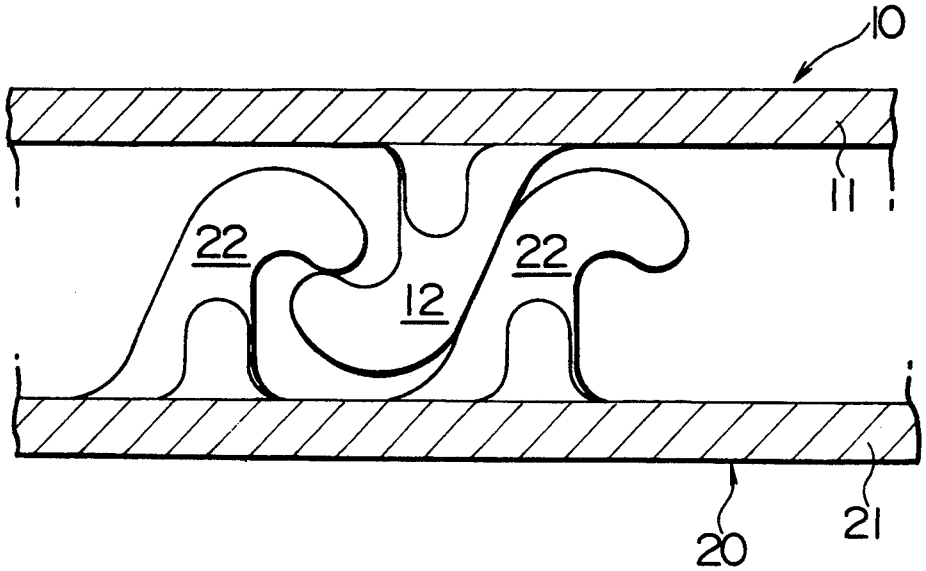
FIG. 2 is a fragmentary side view of the surface fastener midway through the insertion process.
Figure 3:
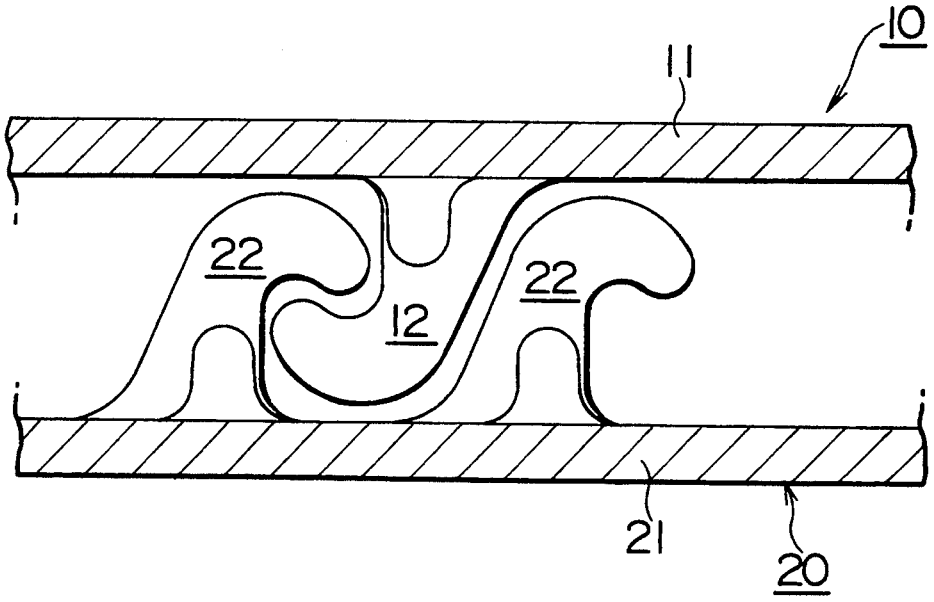
FIG. 3 is a fragmentary side view of the surface fastener in its engaged state.
Figure 4:
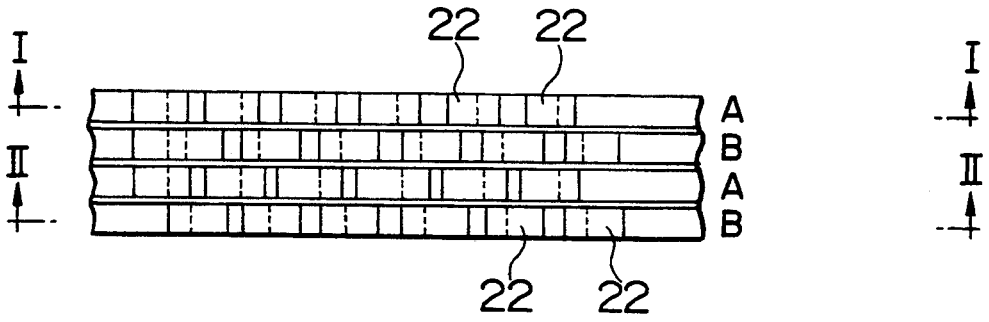
FIG. 4 is a plan view of an example arrangement of the hooks for the surface fastener.
Figure 5A:
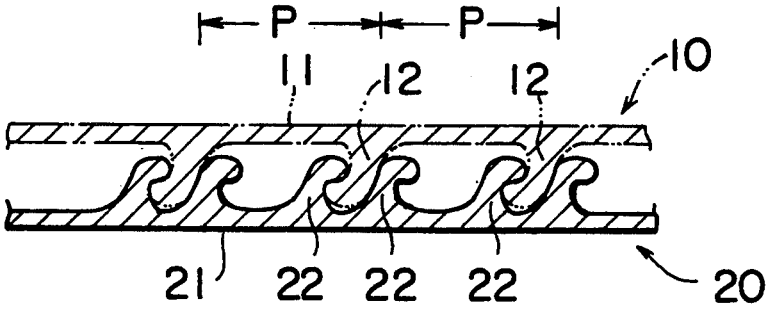
FIGS. 5(*a*) and 5(*b*) are cross-sectional views taken along lines I—I and II—II, respectively, of FIG. 4.
Figure 5B:
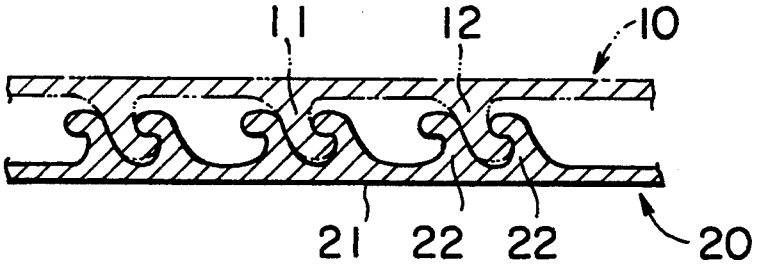

FIGS. 1 to 3 are views of a molded surface fastener for a typical embodiment of the invention in various states of engagement. FIG. 4 is a plan view of an example engaging row arrangement for the same surface fastener. FIGS. 5(*a*) and 5(*b*) are cross-sectional views taken along lines I—I and II—II, respectively, of FIG. 4.

As shown in FIGS. 1 to 3, the surface fastener in this invention is a single body type molded from synthetic resin consisting of first and second engaging layers 10, 20, each of which has a large number of hooks 12, 22 having the same shape projecting vertically at fixed intervals from their corresponding hook beds 11 and 21. The arrangement of this large number of rows of hooks 22 is shown in FIG. 4.

Each individual hook 12, 22 shown in FIGS. 1 to 3 for this invention has the following kind of shape with regards to the hook beds 11, 21; it includes a raised portion (SP) having an inclined back surface (bs) which smoothly curves upwards from the hook beds 11, 21 and a vertical front surface (fs) and a rib (r) formed on either side of raised portion (SP), and a hook shaped engaging portion (FP) extentding forward from the front end of the raised portion (SP). The cross-sectional area of the hook 12, 22 gradually increases when going from the front end of the hook shaped engaging portion (FP) to the base (ba) of the raised portion (SP), eventually reaching a maximum value at this base. Although there is a rib (r) described in the above, this is not actually essential in this invention.

Now, the construction of the surface fastener in this invention is such that the row spacing for the hooks 12 for the first engaging part 10 and the spacing of the hooks 22 for the second engaging part 20 is different. Accordingly, in the example shown in the diagrams, the spacing of the hooks 12 for the first engaging part 10 is taken to be (p), and the spacing for the hooks 22 for the second engaging part 20 is taken to be $\frac{1}{2}$ (p). This is to say that the spacing of the hooks 12 for the first engaging part 10 is twice that of the hooks 22 for the second engaging part 20.

Also, the hooks 12 for the first engaging part 10 and the hooks 22 for the second engaging part 20 are arranged mutually in opposite directions. It can be seen from FIGS. 4 and 5 that the corresponding hooks 12, 22 belonging to reciprocally neighboring hook rows A and B for the first and second engaging parts 10 and 20 are arranged in opposite directions and, as again becomes clear from FIGS. 4 and 5, are staggered with respect to each other.

The hook 12, 22 for the surface fastener in this invention is of a shape which closely resembles that of an ocean wave top just before breaking, as is described above. In addition, the spacing of the hooks 12 for the first engaging part 10 is twice that of the hooks 22 for the second engaging part 20, with the hooks for these two engaging parts facing in opposite directions. This means that when the fastener is engaged, not only can the hook 12 for the first engaging part 10 be inserted smoothly between the two hooks 22 for the second engaging part 20 but also, as is shown in FIGS. 1 to 3, the front end of the hook shaped engaging portion (FP) of the hook 12 projecting from the first engaging part 10 makes contact with the front end of the hook shaped engaging portion (FP) of the hook 22 for the second engaging part 20. At the same time, the back surface (bs) of the hook 22 which is next to the aforementioned hook 22 on the second engaging part 20 and the back surface (bs) of the same hook 12 for the first engaging part 10 make contact and the hook is guided smoothly into position in the sequence shown in FIGS. 2 and 3.

The corresponding hooks 12, 22 for each adjacent hook row A and B for the first and second engaging parts 10, 20 face in opposing directions, as is shown in FIG. 5. The hooks 22 in each of the neighboring hook rows A, B for the second engaging part 20 are staggered. In addition, in the case where the hooks 12 in each of the neighboring hook rows A, B for the first engaging part 10 are also staggered, the hooks are not only held securely in the row direction but are held firmly in the lateral direction.

Moreover, even when separating the first and second engaging parts 10, 20, if a force in excess of the necessary separation force is applied to both of the engaging parts 10, 20 in the direction of separation, the front ends of the mutually interlocked hook shaped engaging portions (FP) will be slightly twisted, and the engaging parts can thus be easily separated. As becomes clear from the above description, according to the surface fastener of this invention, partly since either of the pair of engaging parts is in the form of a single molded body and partly since the pair of engaging parts make hook-to-hook coupling, it would provide sufficient coupling strength free from accidental separation. Also, these hooks have a specific cross-sectional wave-like shape although this is not shown. At the same time, the hooks for the first and second engaging parts face in opposite directions so that the coupling of the elements can take place very smoothly without any damage. It follows that the molded surface fastener according to this invention has a much wider range of application than that of conventional surface fasteners. This invention would therefore be particularly suited to a wide range of fields of applications with regards to industrial materials, where a high degree of performance is necessary.

What is claimed is:

1. A molded surface fastener comprising: first and second engaging parts each including a flat hook bed having on its surface a multiplicity of rows of hooks molded integrally of said flat hook bed;

each of said hooks including a raised portion and a hook-shape engaging portion extending forwardly from a distal end of said raised portion, said raised portion having an inclined back surface smoothly curving upwardly from said hook bed and a vertical front surface, each said hook having a varying cross-sectional area increasing gradually from a distal end of said hook-shape engaging portion to a base of said raised portion; and said hooks of said first engaging part and said hooks of said second engaging part being arranged mutually in opposite directions, the row direction pitch of said hooks of one of said first and second engaging parts being twice the row direction pitch of said hooks of the other engaging part.

2. A molded surface fastener according to claim 1, wherein a rib is formed on at least one side of said base of said raised portion.

3. A molded surface fastener according to claim 1, wherein said hooks of adjacent rows of each of said first and second engaging parts are arranged mutually in opposite directions.

4. A molded surface fastener according to claim 1 or 2, wherein said hooks of adjacent rows of each of said first and second engaging parts are arranged mutually in a staggered manner.

* * * * *